US010337837B2

(12) United States Patent
Keller et al.

(10) Patent No.: US 10,337,837 B2
(45) Date of Patent: Jul. 2, 2019

(54) FLIP SIGHT SYSTEMS FOR FIREARMS

(71) Applicant: Strike Industries, Santa Ana, CA (US)

(72) Inventors: Garrett O'Neill Keller, Santa Ana, CA (US); David Hyung Chin, Huntington Beach, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 15/853,639

(22) Filed: Dec. 22, 2017

(65) Prior Publication Data

US 2018/0180386 A1 Jun. 28, 2018

Related U.S. Application Data

(60) Provisional application No. 62/438,007, filed on Dec. 22, 2016.

(51) Int. Cl.

| | |
|---|---|
| ***F41G 1/033*** | (2006.01) |
| ***F41G 11/00*** | (2006.01) |
| ***F41G 1/16*** | (2006.01) |
| ***F41G 1/04*** | (2006.01) |
| ***F41G 1/06*** | (2006.01) |
| ***F41G 1/08*** | (2006.01) |
| ***F41G 1/17*** | (2006.01) |
| ***F41G 1/18*** | (2006.01) |

(52) U.S. Cl.

CPC ..... *F41G 11/007* (2013.01); *F41G 1/033* (2013.01); *F41G 1/04* (2013.01); *F41G 1/065* (2013.01); *F41G 1/08* (2013.01); *F41G 1/16* (2013.01); *F41G 1/17* (2013.01); *F41G 1/18* (2013.01); *F41G 11/003* (2013.01)

(58) Field of Classification Search

CPC ..... F41G 1/033; F41G 11/007
USPC ..... 42/140, 148, 138
See application file for complete search history.

(56) References Cited

U.S. PATENT DOCUMENTS

| | | | | |
|---|---|---|---|---|
| 2013/0036650 | A1* | 2/2013 | Larue | F41G 11/003 42/148 |
| 2013/0185985 | A1* | 7/2013 | Ballard | F41G 1/00 42/148 |
| 2014/0150324 | A1* | 6/2014 | Keng | F41G 11/003 42/118 |
| 2016/0102941 | A1* | 4/2016 | Brucker | F41G 1/17 42/148 |

* cited by examiner

*Primary Examiner* — Reginald S Tillman, Jr.
(74) *Attorney, Agent, or Firm* — Andy M. Han; Han IP PLLC

(57) ABSTRACT

Flip sight systems having multiple configurations for use with firearms in accordance with various embodiments of the invention are disclosed. In one embodiment, a flip sight system is provided, comprising: a front sight assembly comprising: a front base, a front pivot joint; and a front sight; a rear sight assembly comprising: a rear base, a rear pivot joint, and a rear sight; wherein the flip sight system includes a first deployed configuration where the front sight and the rear sight are offset to the attached optics such that the flip sight system operates as primary sights for close range targets, a second deployed configuration where the front sight and the rear sight are in-line with the attached optics such that the flip sight system operates as co-witness or backup sights to the attached optics, a first collapsed configuration for storage, and a second collapsed configuration for storage.

20 Claims, 17 Drawing Sheets

FLIP SIGHT SYSTEMS FOR FIREARMS

CROSS-REFERENCE TO RELATED APPLICATIONS

This current application claims priority to U.S. Provisional Patent Application No. 62/438,007 filed Dec. 22, 2016, the disclosure of which is incorporated herein in its entirety by reference.

FIELD OF THE INVENTION

The present invention generally relates to firearms and more specifically to flip sight systems for firearms having multiple configurations.

BACKGROUND

A variety of sight systems may be used to assist a user in aiming a firearm. For example, a firearm may include iron sights (may also be referred to as "iron sights," "back-up iron sights," or "metallic sights") comprising of two or more shaped alignment markers. Typically, one marker is placed on a rear sight which is mounted perpendicular to the line of sight of the user. Another marker is placed on a front sight where the markers on the front sight and the rear sight are aligned in positioning of the rifle to the desired target. Firearms may also include optical sights comprising an optical device that generates an image that includes an aligned aiming point in focus with the target. Further, firearms may also include telescopic sights that may include an optical refracting telescope to magnify the target and its surrounding area. Moreover, a firearm may include laser sights to project an aiming point or visible "dot" onto the target.

SUMMARY

The various embodiments of the flip sight systems for firearms have several features, no single one of which is solely responsible for their desirable attributes. Without limiting the scope of the present embodiments as expressed by the claims that follow, their more prominent features will now be discussed below. After considering this discussion, and particularly after reading the section entitled "Detailed Description," one will understand how the features of the present embodiments provide the advantages described here.

One aspect of the present embodiments includes the realization that if an optic is mounted on a firearm, previous standard flip sights (not the current embodiments) when in use position, the optic must be used in unison with the flip sights. Further, with standard flip sights, it may be difficult and tedious zeroing the flip sights with the optics to allow for proper alignment when firing. In addition, with standard flip sights, if the optic is damaged such that a user cannot see through the optics, it may render the standard flip sights useless as the optic may obstruct the view of the user when aligning the rear and front sight for use. This may be especially problematic as flip sights may be used for backup or emergency situations where a user might not have enough time to remove a mounted optic. It would be advantageous, therefore, if a flip sighting system may be used regardless of the conditions of a mounted optics, fold away for minimized damage during transportation, and allow for optics to be used without interference from the flip sights even when deployed. Further, it would be advantageous if the flip sight system provides a user with multiple angular positions in which to lock the sights in for target acquisition or storage and remain low profile from other accessories. Therefore, there is a need in the firearms industry for a flip sight system for firearms having multiple configurations.

In a first aspect, a flip sight system having multiple configurations for use with a firearm having an attached optics is provided, the flip sight system comprising: a front sight assembly configured to attach to the firearm, comprising: a front base configured to attach the front sight assembly to the firearm; a front pivot joint configured to attach the front base with a front sight; and a front sight configured to attach to the front base using the front pivot joint; a rear sight assembly configured to attach to the firearm, comprising: a rear base configured to attach the rear sight assembly to the firearm; a rear pivot joint configured to attach the rear base with a rear sight; and a rear sight configured to attach to the rear base using the rear pivot joint; wherein the flip sight system includes a first deployed configuration where the front sight and the rear sight are offset to the attached optics such that the flip sight system operates as primary sights for close range targets; wherein the flip sight system includes a second deployed configuration where the front sight and the rear sight are in-line with the attached optics such that the flip sight system operates as co-witness or backup sights to the attached optics; wherein the flip sight system includes a first collapsed configuration for storage; and wherein the flip sight system includes a second collapsed configuration for storage.

In an embodiment of the first aspect, the front base configured to attach the front sight assembly to the firearm includes: a first detent stop and a second detent stop; the front pivot joint configured to attach the front base with the front sight includes a spring detent for engaging with the first detent stop or the second detent stop of the front base, a deployed detent stop, and a collapsed detent stop; and the front sight configured to attach to the front base using the front pivot joint includes a front alignment marker and an internal spring detent for engaging with the deployed dent stop or the collapsed dent stop of the front pivot joint.

In another embodiment of the first aspect, the rear base configured to attach the rear sight assembly to the firearm includes a first detent stop and a second detent stop; the rear pivot joint configured to attach the rear base with the rear sight includes a spring detent for engaging with the first detent stop or the second detent stop of the base, a deployed detent stop, and a collapsed detent stop; and the rear sight configured to attach to the rear base using the rear pivot joint includes a rear alignment marker and an internal spring detent for engaging with the deployed dent stop or the collapsed dent stop of the rear pivot joint.

In another embodiment of the first aspect, the flip sight system is in the first deployed configuration when the front sight assembly is configured to a first deployed configuration where the spring detent of the front pivot joint is engaged with the first detent stop of the front base and the internal spring detent of the front sight is engaged with the deployed detent stop of the front base; and the rear sight assembly is configured to a first deployed configuration where the spring detent of the rear pivot joint is engaged with the first detent stop of the rear base and the internal spring detent of the rear sight is engaged with the deployed detent stop of the rear base.

In another embodiment of the first aspect, the flip sight system is in the second deployed configuration when the front sight assembly is configured to a second deployed configuration where the spring detent of the front pivot joint is engaged with the second detent stop of the front base and the internal spring detent of the front sight is engaged with the deployed detent stop of the front base; and the rear sight assembly is configured to a second deployed configuration where the spring detent of the rear pivot joint is engaged with the second detent stop of the rear base and the internal spring detent of the rear sight is engaged with the deployed detent stop of the rear base.

In another embodiment of the first aspect, the flip sight system is in the first collapsed configuration when the front sight assembly is configured to a first collapsed configuration where the spring detent of the front pivot joint is engaged with the first detent stop of the front base and the internal spring detent of the front sight is engaged with the collapsed detent stop of the front base; and the rear sight assembly is configured to a first collapsed configuration where the spring detent of the rear pivot joint is engaged with the first detent stop of the rear base and the internal spring detent of the rear sight is engaged with the collapsed detent stop of the rear base.

In another embodiment of the first aspect, the flip sight system is in the second collapsed configuration when the front sight assembly is configured to a second collapsed configuration where the spring detent of the front pivot joint is engaged with the second detent stop of the front base and the internal spring detent of the front sight is engaged with the collapsed detent stop of the front base; and the rear sight assembly is configured to a second collapsed configuration where the spring detent of the rear pivot joint is engaged with the second detent stop of the rear base and the internal spring detent of the rear sight is engaged with the collapsed detent stop of the rear base.

In another embodiment of the first aspect, the attached optics is positioned between the front sight assembly and the rear sight assembly.

In another embodiment of the first aspect, the attached optics is one of a telescopic sight, electronic red dot sight, holographic sight, and open sight.

In another embodiment of the first aspect, wherein in the first deployed configuration, the front sight and the rear sight are offset to the attached optics by 45 degrees from a center line of the firearm.

In another embodiment of the first aspect, wherein a rail is attached to the firearm and the attached optics and flip sight system are attached to the firearm by attaching to the rail.

In another embodiment of the first aspect, the flip sight system is attached to the rail using one of a clamp and a quick detachment mount.

In another embodiment of the first aspect, the front alignment marker is a post that is click adjustable for elevation using a knob.

In another embodiment of the first aspect, the rear alignment marker is an aperture that is click adjustable for windage using a knob.

In another embodiment of the first aspect, the front sight assembly and the rear sight assembly operate independently of each other.

In another embodiment of the first aspect, the alignment marker of the rear sight assembly matches up with the alignment marker of the front sight assembly at a point of alignment.

In another embodiment of the first aspect, a bore to sight distance is measured as the distance between the point of alignment and a center of a bore axis of a firearm.

In another embodiment of the first aspect, the bore to sight distance is larger in the first deployed configuration than in the second deployed configuration.

In another embodiment of the first aspect, the bore to sight distance is smaller in the first deployed configuration than in the second deployed configuration.

In another embodiment of the first aspect, the flip sight system transitions from the first deployed configuration to the second deployed configuration by rotating of the front and rear sights about a longitudinal axis to the bore axis.

DETAILED DESCRIPTION OF THE DRAWINGS

Figure 1A:
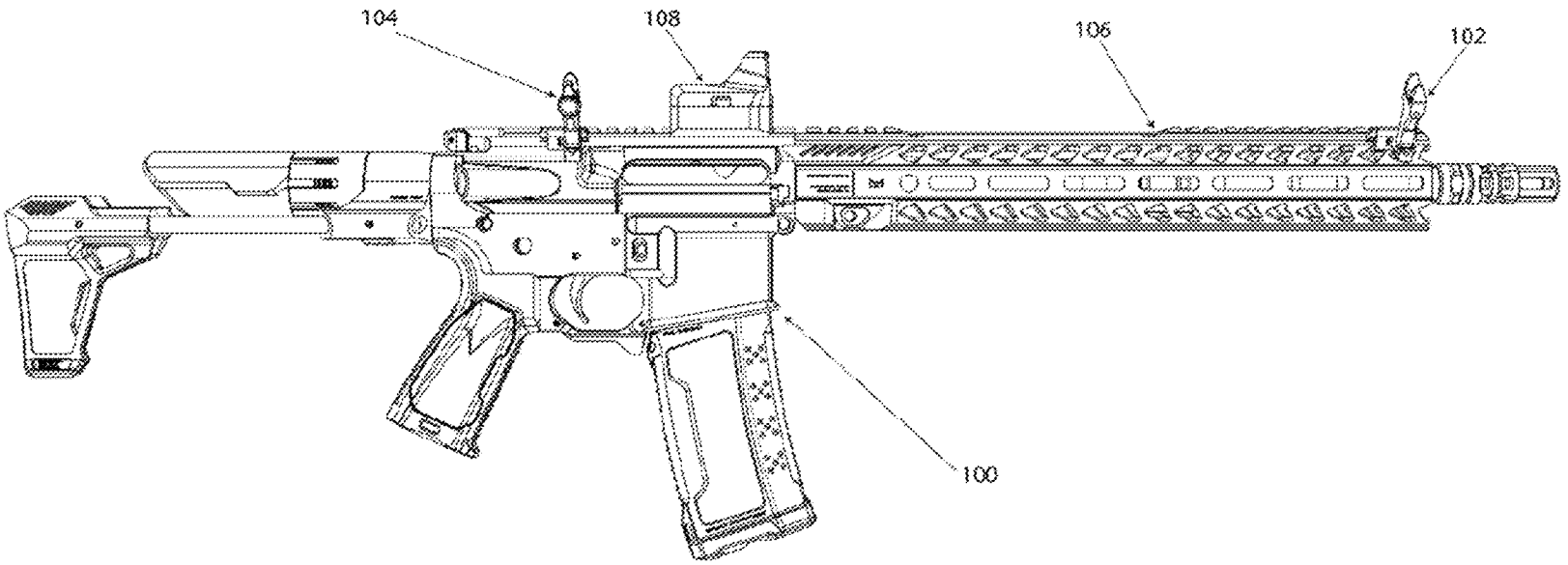
FIG. 1A is a right side view of a firearm with a flip sight system in accordance with an embodiment of the invention.

Turning now to the drawings, flip sight systems for firearms having multiple configurations that may serve as primary and/or backup sights in accordance with embodiments of the invention are disclosed. Typically, the flip sight system is attached to a firearm equipped with some type of attached optics such as (but not limited to) telescopic, electronic red dot, holographic, or open sights. In many embodiments, the flip sight system includes a front sight assembly and a rear sight assembly that attaches to the firearm such that the attached optics are positioned between the front and the rear sight assemblies. In various embodiments, the flip sight system may be configured into a first deployed configuration where the front and rear sights are offset to the attached optics allowing for the flip sight system to operate as the primary sights. In several embodiments, the front and rear sight assemblies may be configured into a second deployed configuration where the flip sight system is in-line with the attached optics allowing for the flip sight system to co-witness and/or serve as backup sights to the attached optics. In addition to the deployed configurations, the flip sight system may also be configured into a first collapsed configuration and a second collapsed configuration for optimal storage. In many embodiments, the transition from the first deployed position to the second deployed position (and vice versa) includes a rotation of the front and rear sights about a longitudinal axis to the bore of the firearm (may also be referred to as the "bore axis").

Flip sight systems in accordance with embodiments of the invention allow for the capability to have a sighting system that fulfills both top in-line, as well as offset, configurations. For example, when the flip sight system is placed in the first deployed configurations (may also be referred to as "45 degree offset position"), the offset position may allow a shooter (also referred to as "user") to use a telescopic sight for far range, and the offset flip sights for faster target acquisition for short range or reflexive shooting. When the flip sight system is in the first collapsed configuration, the offset folded position allows for the ability to mount telescopic sights with larger objective lenses that would otherwise preclude the ability to mount traditional folding back up iron sights (traditional fixed models are undesirable due to the high profile and snag hazard). When the flip sight system is in the second deployed configuration (may also be referred to as "in-line position"), the in-line position of the front and rear sights to the attached optics may create a more intuitive and repeatable usage. Furthermore, it may be desirable to have in-line sights that serve as a mechanical back up to 1× electro-optics.

As described above, one aspect of the present embodiments includes the realization that if an optic is mounted on a firearm, previous standard flip sights (not the current embodiments) when in use position, the optic must be used in unison with the flip sights. Further, with standard flip sights, it may be difficult and tedious zeroing the flip sights with the optics to allow for proper alignment when firing. In addition, with standard flip sights, if the optic is damaged such that a user cannot see through the optics, it may render the standard flip sights useless as the optic may obstruct the view of the user when aligning the rear and front sight for use. This may be especially problematic as flip sights may be used for backup or emergency situations where a user might not have enough time to remove a mounted optic. It would be advantageous, therefore, if a flip sighting system may be used regardless of the conditions of a mounted optics, fold away for minimized damage during transportation, and allow for optics to be used without interference from the flip sights even when deployed. Further, it would be advantageous if the flip sight system provides a user with multiple angular positions in which to lock the sights in for target acquisition or storage and remain low profile from other accessories. Flip sight systems having such advantages using multiple configurations in accordance with embodiments of the invention are described further below.

Flip Sight Systems

Firearms are typically equipped with some type of sighting systems such as (but not limited to) telescopic sights, electronic red dot or holographic sights, or iron sights (may also be called "open sights"). However, many traditional sighting systems may introduce undesirable conditions. For example, telescopic sights often preclude the simultaneous usage of iron sights. In addition, while telescopic sights enhance vision at further ranges, they may also restrict field of view which may be detrimental to short range or reflexive shooting situations. Furthermore, higher power telescopic sights may be so large as to preclude the mounting of typical folding iron sights. Also, electronic sights may be prone to breakage or loss of battery power. Flip sight systems in accordance with embodiments of the invention may be configured to operate as primary sights, back-up sights, or to co-witness with a variety of attached optics as further described below.

Further, flip sight systems in accordance with embodiments of the invention may be configured to collapse into a variety of storage configurations.

Figure 1B:
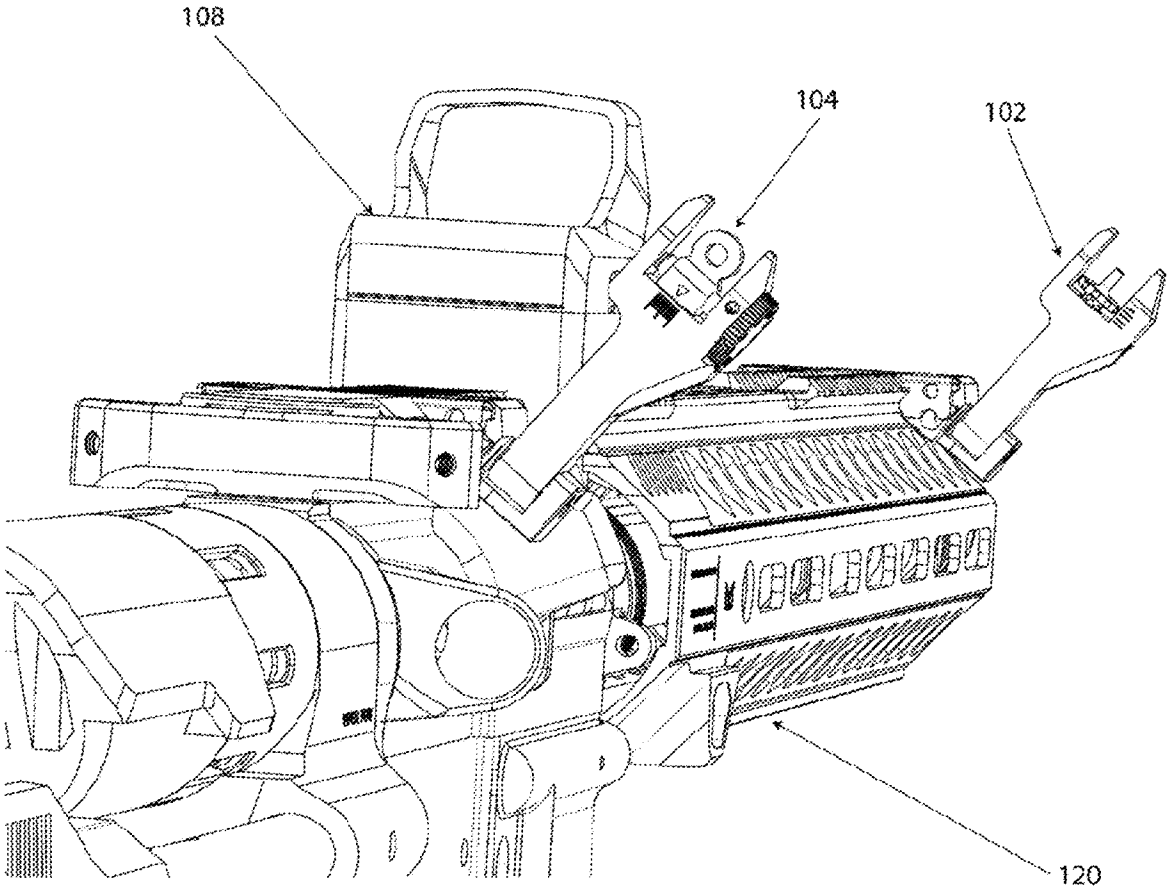
FIG. 1B is a rear perspective view of a firearm with a flip sight system in accordance with an embodiment of the invention.
Figure 1C:
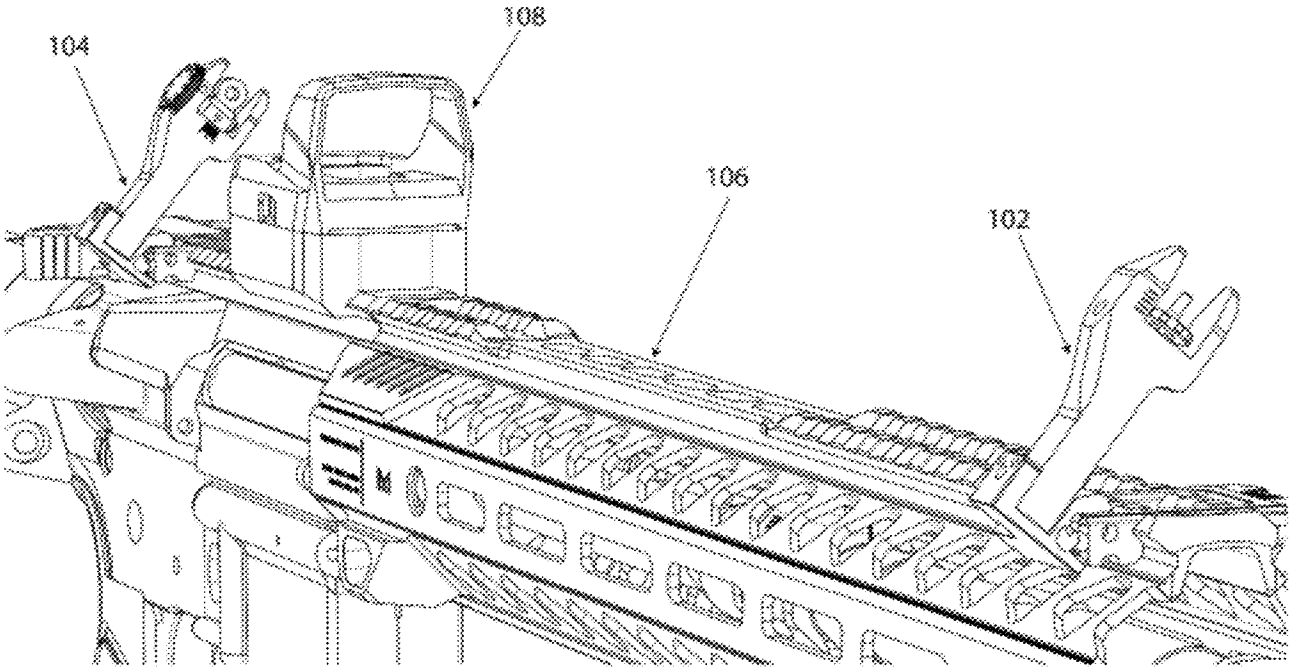
FIG. 1C is a front perspective view of a firearm with a flip sight system in accordance with an embodiment of the invention.

A flip sight system in accordance with an embodiment of the invention is illustrated in FIGS. 1A-C. A right side view of a firearm having a flip sight system is illustrated in FIG. 1A. The diagram 100 shows a firearm that includes a rail 106 attached to the firearm. In many embodiments, the rail 106 may be a bracket system that provides a mounting platform having rails with multiple transverse slots to mount a variety of accessories and attachments. For example, the rail may be a Picatinny rail or some other tactical rail as appropriate to the particular firearm. In various embodiments, the firearm also includes an attached optics 108 that may be attached to the rail 106 of the firearm and utilized as primary sights depending on the situation that a user of the firearm may be facing. In some embodiments, the attached optics 108 may be (but is not limited to) a telescopic, electronic red dot or holographic sights, or iron sights. The diagram 100 also includes a flip sight system having a front sight assembly 102 and a rear sight assembly 104 attached to the rail 106 as further described below.

A rear perspective view of a firearm with a flip sight system in accordance with an embodiment of the invention is illustrated in FIG. 1B. The diagram 120 shows the front sight assembly 102 and the rear sight assembly 104 in first deployed configurations as further described below. In several embodiments, the attached optics 108 are positioned between the front sight assembly 102 and the rear sight assembly 104. Typically, when the flip sight system is in the first deployed configuration, the front and rear sight assemblies 102, 104 may be optimal for targets closer in proximity and the attached optics 108 may be optimal for targets further away. In some embodiments, the front sight assembly 102 and the rear sight assembly 104 may be configured into, but not limited to, a 45 degree offset front, top, center line of the firearm.

A front perspective view of a firearm with a flip sight system in accordance with an embodiment of the invention is illustrated in FIG. 1C. The diagram 140 shows the front sight assembly 102 and the rear sight assembly 104 in second deployed configurations as further described below. Typically, when the flip sight system is in the second deployed configuration, the front sight assembly 102 and the rear sight assembly 104 are configured to be in-line with the attached optics 108 for back-up and/or co-witnessing.

Although specific flip sight systems having a first and a second configuration are discussed above, any of a variety of flip sight systems having multiple configurations for aiming a firearm as appropriate to the requirements of a specific application can be utilized in accordance with embodiments of the invention. Front and rear sight assemblies for flip sight systems in accordance with embodiments of the invention are discussed further below.

Front and Rear Sight Assemblies

Figure 2A:
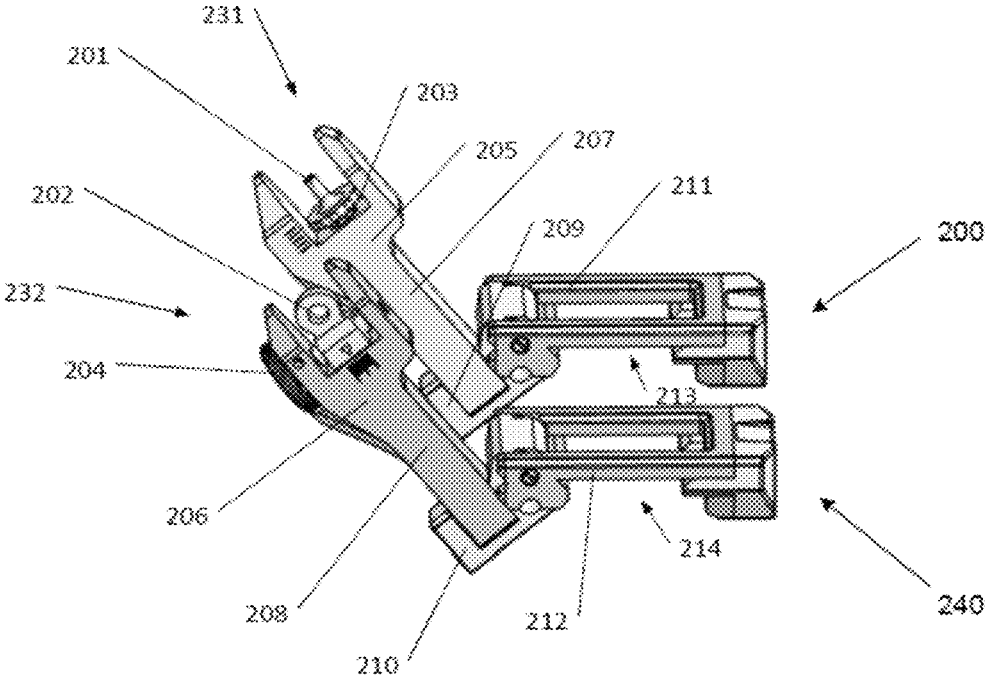
FIGS. 2A-B are schematic diagrams illustrating a front sight assembly and a rear sight assembly in a first deployed configurations in accordance with an embodiment of the invention.
Figure 2B:
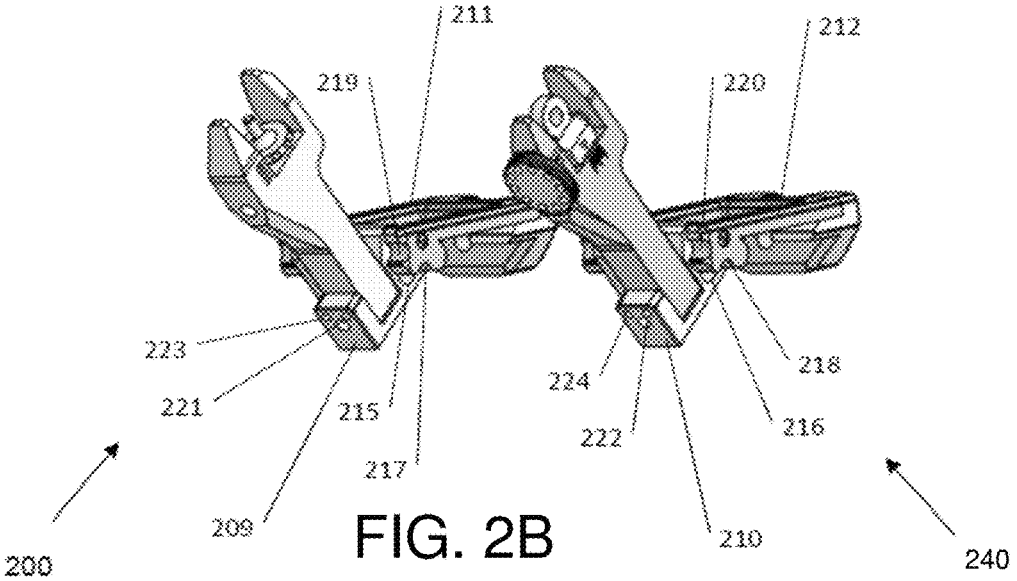

A flip sight system may comprise a front sight assembly and a rear sight assembly, where the front and rear sight assemblies may be independently configured into various configurations as described below. Schematic diagrams illustrating a front sight assembly and a rear sight assembly in first deployed configurations in accordance with an embodiment of the invention are illustrated in FIGS. 2A-B. In reference to FIG. 2A, a flip sight system may include a front sight assembly 200 and a rear sight assembly 240. In many embodiments, the front sight assembly 200 may include a front sight 231 comprising a tower portion 205 that includes a front alignment marker such as (but not limited to) a post 201 that is click adjustable for elevation using a knob 203. The tower portion 205 may be attached to a base 211 by a rotating arm 207 using a pivot joint 209 that allows the front sight assembly 200 to be configured into a first collapsed, a first deployed, a second collapsed, or a second deployed configurations. In some embodiments, the front sight assembly 200 may be attached to a rail of a firearm using a clamp 213. In various embodiments, the rear sight assembly 240 may include a rear sight 232 comprising a tower portion 206 that includes a rear alignment marker such as (but not limited to) an aperture 202 that is click adjustable for windage using a knob 204. The tower 206 may be attached to a base 212 by a rotating arm 208 using a pivot joint 210 that allows the rear sight assembly 240 to be configured into a first collapsed, a first deployed, a second collapsed, or a second deployed configurations. In some embodiments, the rear sight assembly 240 may also be attached to a rail of a firearm using a clamp 214. Although specific attachment methods using clamps are illustrated, any of a variety of attachment methods such as (but not limited) to quick detachment ("QD") mounts and sockets and various other attachment methods as appropriate to the requirements of a specific application may be used to attach the front and rear sight assemblies to a rail of a firearm in accordance with embodiments of the invention.

In reference to FIG. 2B, the base 211 of the front sight assembly 200 may include a first detent stop 217 and a second detent stop 219 for engaging a spring detent 215 located on the pivot joint 209. Further, the pivot joint 209 may include a collapsed detent stop 223 and a deployed detent stop 221 for engaging an internal spring detent (not shown) on the rotating arm 207. As illustrated in FIG. 2B (and in FIG. 2A), the front sight assembly 200 is in a first deployed configuration when the spring detent 215 is engaged with the first detent stop 217 and the internal spring detent is engaged with the deployed detent stop 221. In many embodiments, the front sight assembly 200 may be placed in a first collapsed configuration when the spring detent 215 is engaged with the first detent stop 217 and the internal spring detent is engaged with the collapsed detent stop 223.

In further reference to FIG. 2B, the base 212 of the rear sight assembly 240 may include a first detent stop 218 and a second detent stop 220 for engaging a spring detent 216 located on the pivot joint 210. Further, the pivot joint 210 may include a collapsed detent stop 224 and a deployed detent stop 222 for engaging an internal spring detent (not shown) on the rotating arm 208. As illustrated in FIG. 2B (and in FIG. 2A) the rear sight assembly 240 is in a first deployed configuration when the spring detent 216 is engaged with the first detent stop 218 and the internal spring detent is engaged with the deployed detent stop 222. In various embodiments, the rear sight assembly 240 may take on a first collapsed configuration when the spring detent 216 is engaged with the first detent stop 218 and the internal spring detent is engaged with the collapsed detent stop 224.

Figure 2C:
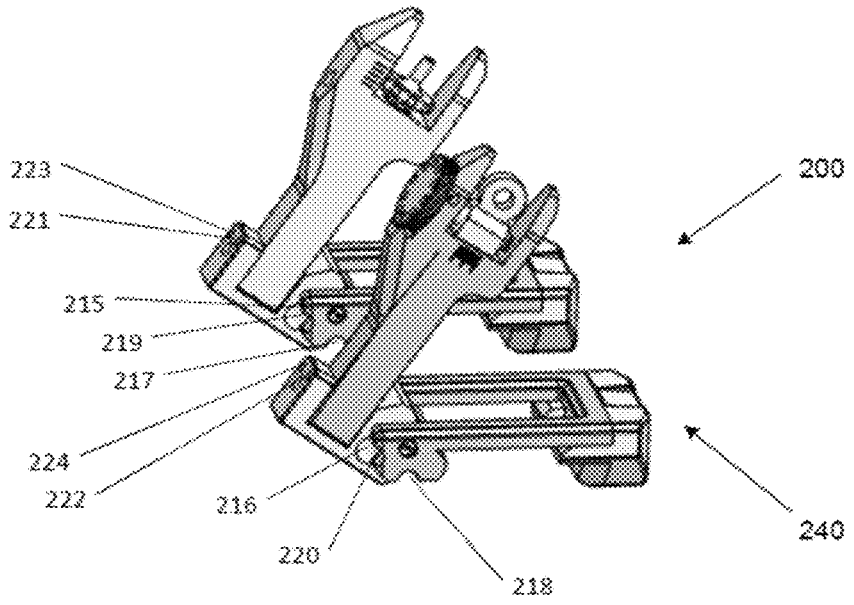
FIGS. 2C-D are schematic diagrams illustrating a front sight assembly and rear sight assembly in a second deployed configurations in accordance with an embodiment of the invention.
Figure 2D:
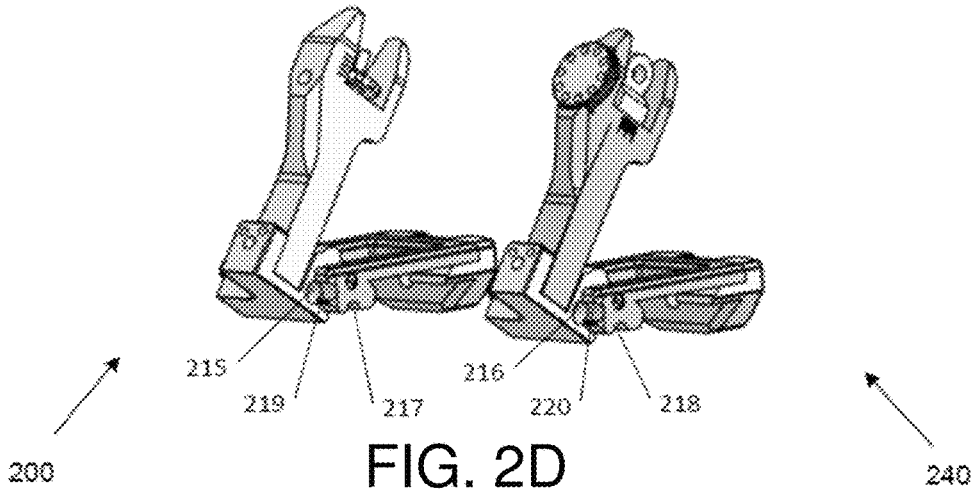

Schematic diagrams illustrating a front sight assembly and a rear sight assembly in a second deployed configurations in accordance with an embodiment of the invention are illustrated in FIGS. 2C-D. As illustrated in FIGS. 2C-D, the front sight assembly 200 is in a second deployed configuration when the spring detent 215 is engaged with the second detent stop 219 and the internal spring detent is engaged with the deployed detent stop 221. In several embodiments, the front sight assembly 200 may be placed in a second collapsed configuration when the spring detent 215 is engaged with the second detent stop 219 and the internal spring detent is engaged with the collapsed detent stop 223. As illustrated in FIGS. 2C-D, the rear sight assembly 240 is in a second deployed configuration when the spring detent 216 is engaged with the second detent stop 220 and the internal spring detent is engaged with the deployed detent stop 222. In many embodiments, the rear sight assembly 240 may be placed in a second collapsed configuration when the spring detent 216 is engaged with the second detent stop 220 and the internal spring detent is engaged with the collapsed detent stop 224.

Although specific configurations of front and rear sight assemblies are discussed above with respect to FIGS. 2A-D, any of a variety of configurations as appropriate to the requirements of a specific application can be used in accordance with embodiments of the invention. Sight flip systems in various configurations in accordance with embodiments of the invention are discussed further below.

Configurations of Flip Sight Systems

Figure 3A:
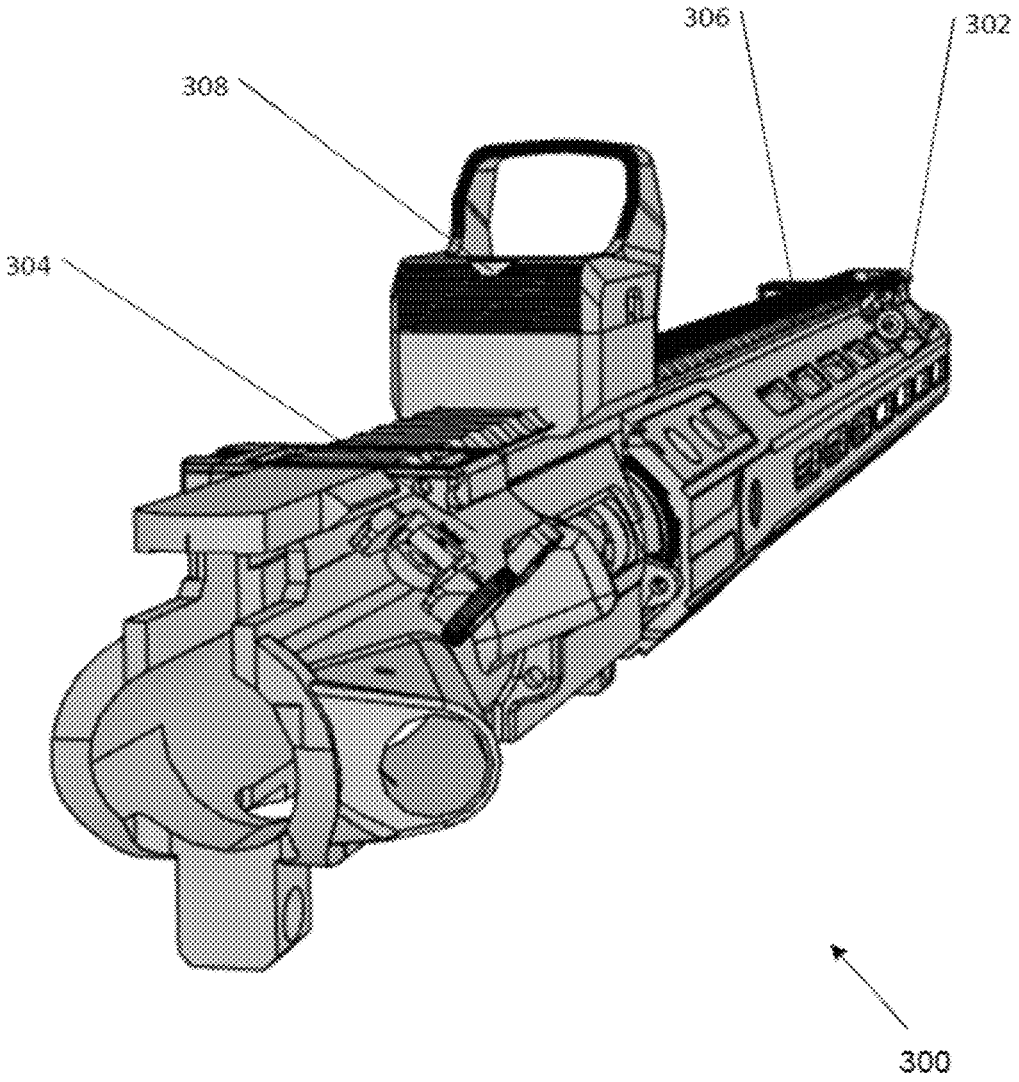
FIG. 3A is a schematic diagram illustrating a flip sight system in a first collapsed configuration in accordance with an embodiment of the invention.

A flip sight system may be configured into a particular configuration when the front and rear sight assemblies are placed in matching configurations. A schematic diagram illustrating a flip sight system in a first collapsed configuration in accordance with an embodiment of the invention is illustrated in FIG. 3A. The diagram 300 shows a flip sight system comprising a front sight assembly 302 and a rear sight assembly 304 attached to a rail 306 of a firearm. Also shown is an attached optics 308 attached to the rail 306 that is positioned between the front sight assembly 302 and the rear sight assembly 304. The flip sight system is in a first collapsed configuration when both the front sight assembly 302 and the rear sight assembly 304 are placed into their first collapsed configurations, respectively, as discussed above. However, the front sight assembly 302 and the rear sight assembly 304 may operate independently of each other. Typically, the flip sight system is placed in the first collapsed configuration for storage. In such configuration, the attached optics 308 may be used as the primary sights.

Figure 3B:
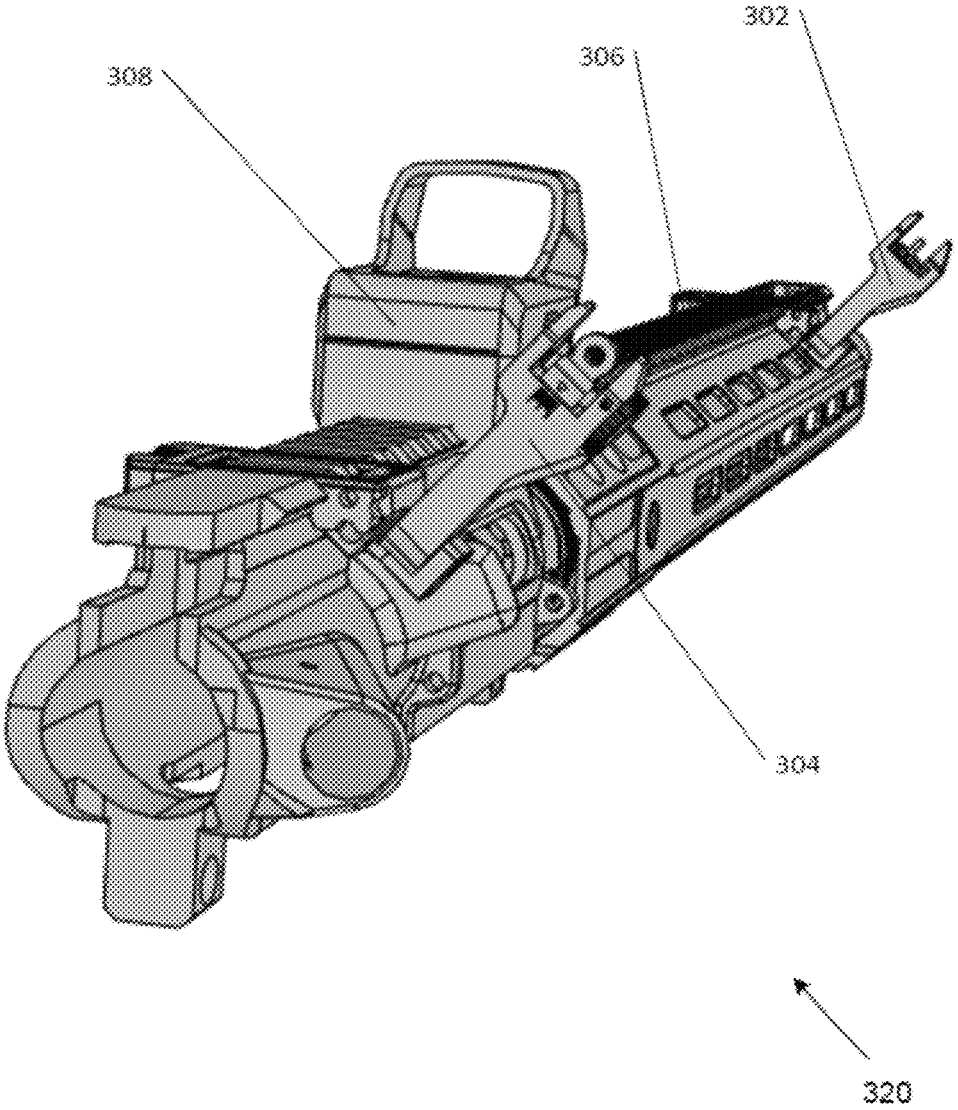
FIG. 3B is a schematic diagram illustrating a flip sight system in a first deployed configuration in accordance with an embodiment of the invention.

A schematic diagram illustrating a flip sight system in a first deployed configuration in accordance with an embodiment of the invention is illustrated in FIG. 3B. The diagram 320 shows the flip sight system comprising a front sight assembly 302 and a rear sight assembly 304 attached to a rail 306 of a firearm. As illustrated, the flip sight system is in a first deployed configuration when both the front sight assembly 302 and the rear sight assembly 304 are placed into their first deployed configurations, respectively, as discussed above. Typically, the flip sight system may be placed in the first deployed configuration for use as the primary sights for close range targets. In many embodiments, a user may rotate the firearm and/or tilt their head such that the user would be looking into the alignment mark of the rear sight assembly 304 to match up with the alignment mark of the front sight assembly 302.

Figure 3C:
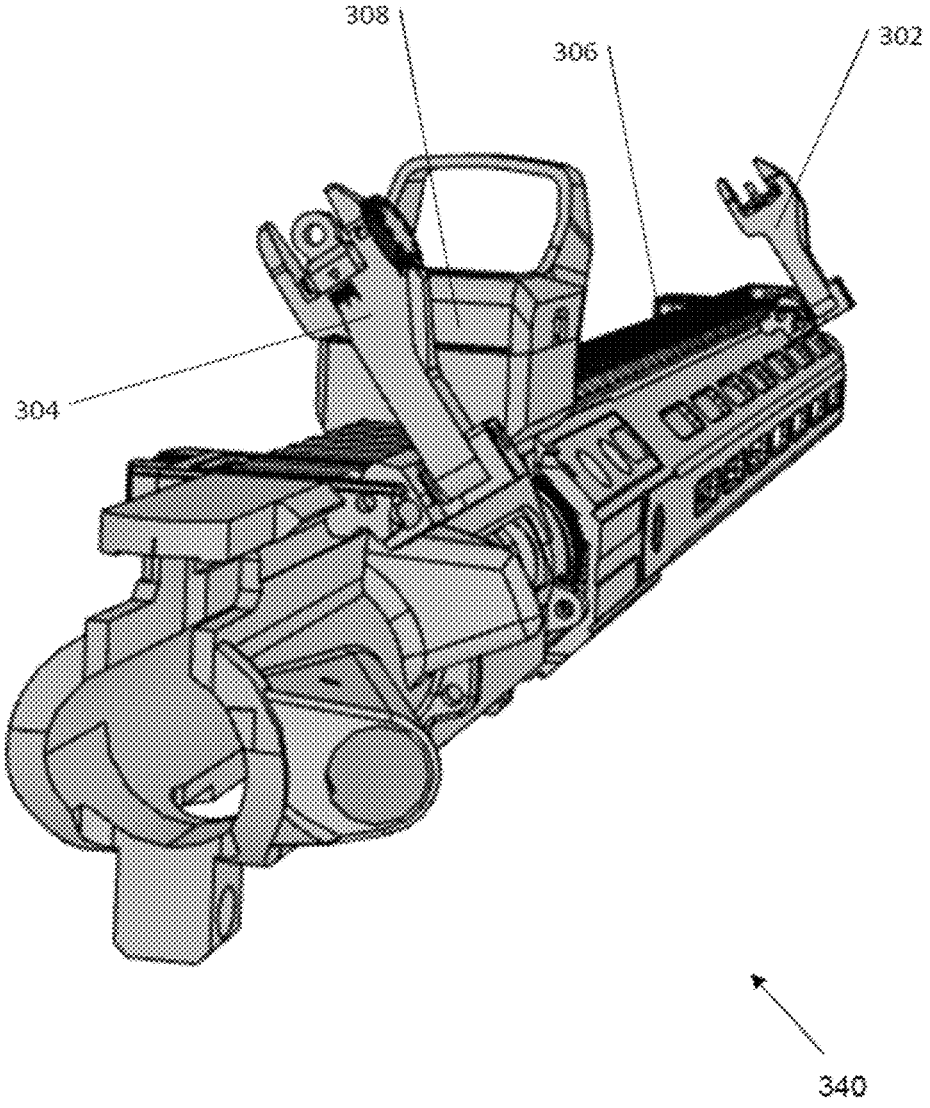
FIG. 3C is a schematic diagram illustrating a flip sight system in a second deployed configuration in accordance with an embodiment of the invention.

A schematic diagram illustrating a flip sight system in a second deployed configuration in accordance with an embodiment of the invention is illustrated in FIG. 3C. The diagram 340 shows the flip sight system comprising a front sight assembly 302 and a rear sight assembly 304 attached to a rail 306 of a firearm. As illustrated, the flip sight system is in a second deployed configuration when both the front sight assembly 302 and the rear sight assembly 304 are placed into their second deployed configurations, respectively, as discussed above. Typically, the flip sight system may be placed in the second deployed configuration for use as back-up sights to the attached optics 308. Further, in such configurations, the alignment mark of the rear sight assembly 304 and the alignment mark of the front sight assembly 302 may be in-line with the attached optics such that it allows for the flip sight system to co-witness with the attached optics 308.

Figure 3D:
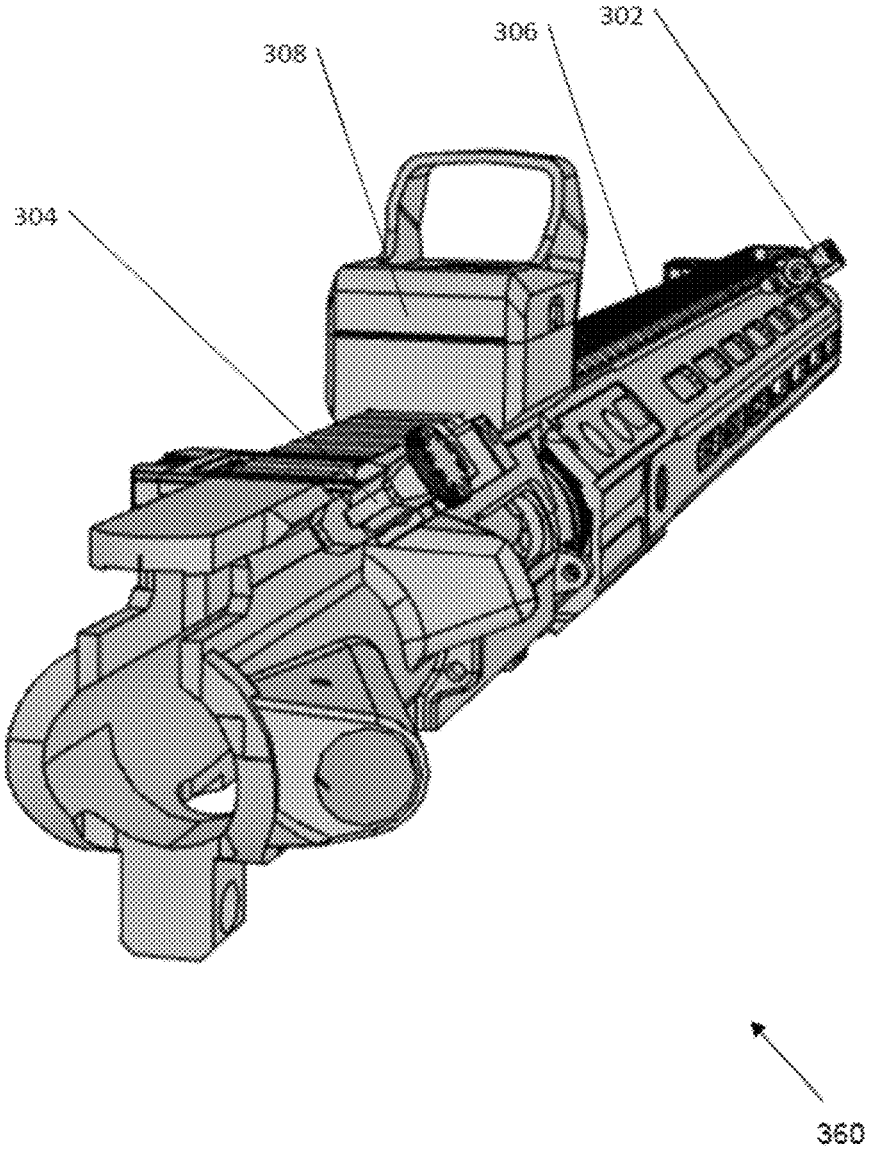
FIG. 3D is a schematic diagram illustrating a flip sight system in a second collapsed configuration in accordance with an embodiment of the invention.

A schematic diagram illustrating a flip sight system in a second collapsed configuration in accordance with an embodiment of the invention is illustrated in FIG. 3D. The diagram 360 shows the flip sight system comprising a front sight assembly 302 and a rear sight assembly 304 attached to a rail 306 of a firearm. As illustrated, the flip sight system is in a second collapsed configuration when both the front sight assembly 302 and the rear sight assembly 304 are placed into their second collapsed configurations, respectively, as discussed above. Typically, the flip sight system may be placed in the second collapsed configuration for storage where the attached optics 308 may be used as the primary sights. Further, the second collapsed configuration allows for the flip sight system to transition more readily to the second deployed configuration for back-up and/or co-witnessing capabilities.

Figure 4A:
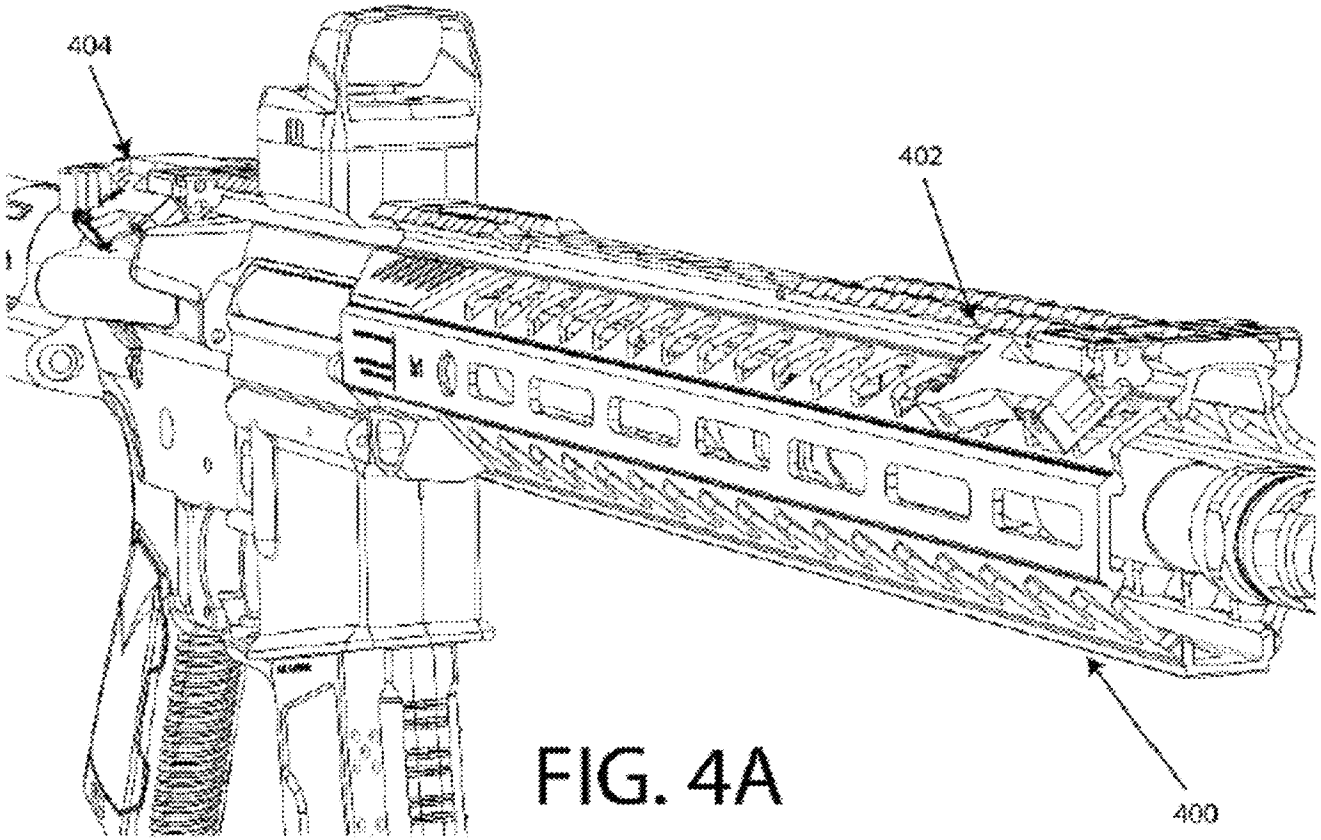
FIGS. 4A-C are diagrams illustrating a flip sight system transitioning from a first collapsed configuration to a first deployed configuration in accordance with an embodiment of the invention.
Figure 4B:
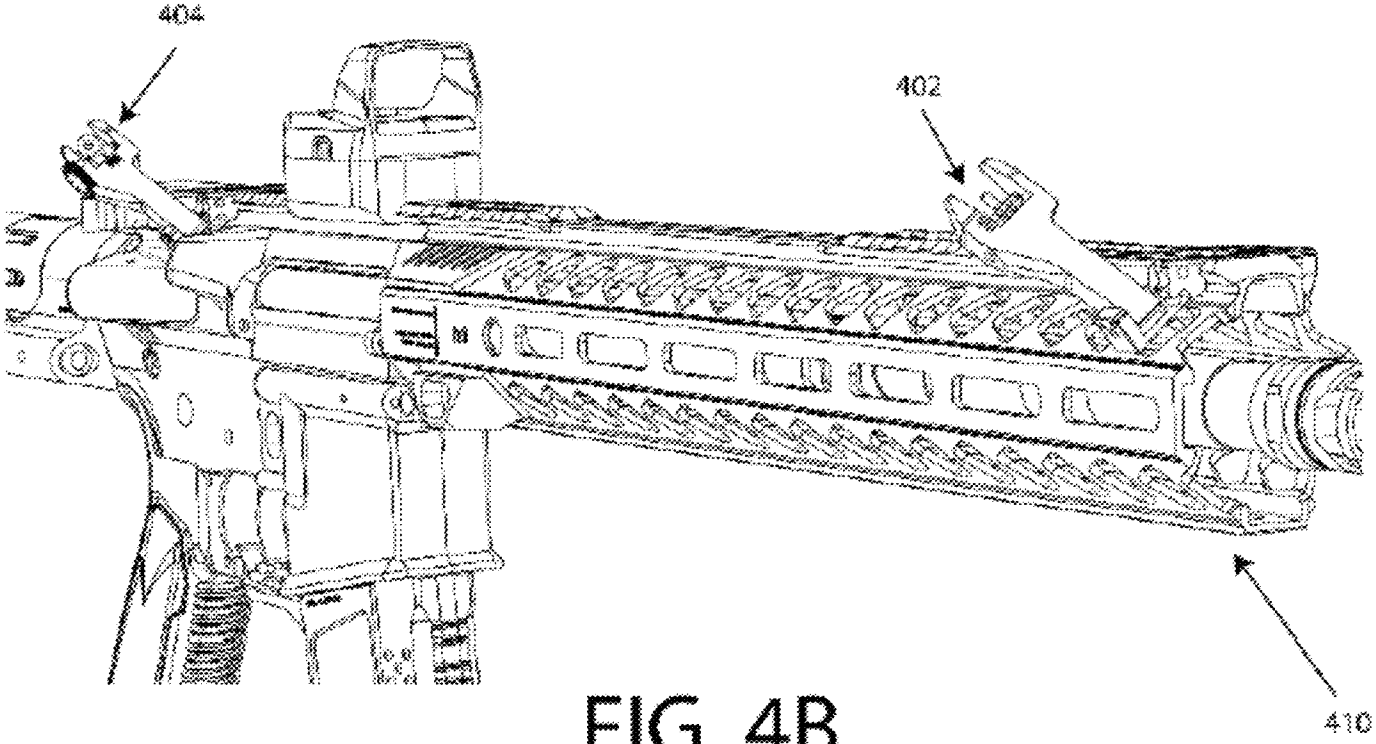
Figure 4C:
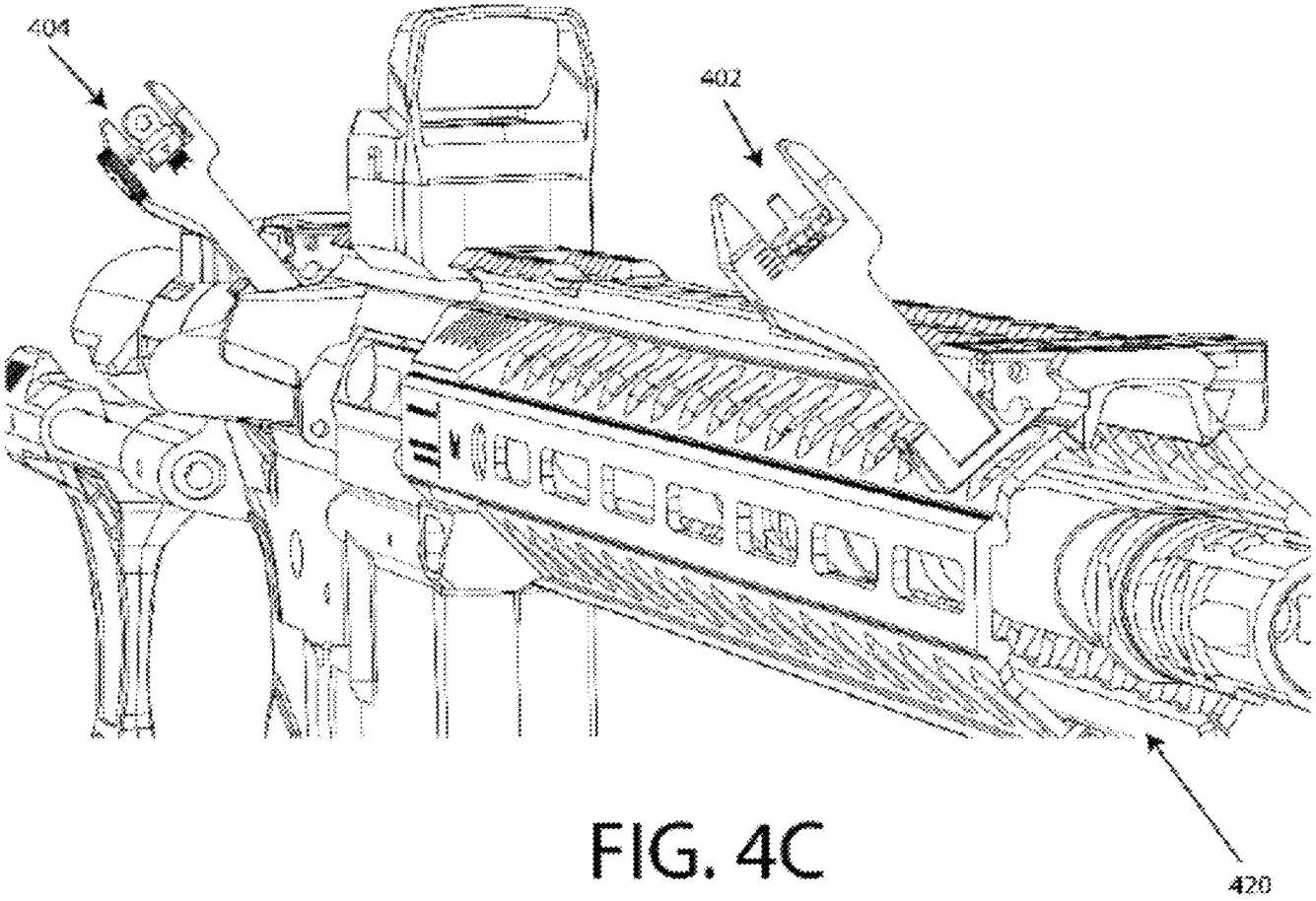

Diagrams illustrating a flip sight system transitioning from a first collapsed configuration to a first deployed configuration in accordance with an embodiment of the invention are illustrated in FIGS. 4A-C. In the first time sequence, the diagram 400 shows the front sight assembly 402 and the rear sight assembly 404 in a first collapsed configuration as discussed above. In the second time sequence, the diagram 410 shows the front sight assembly 402 and the rear sight assembly 404 in transition from the first collapsed configuration to the first deployed configuration. In the third time sequence, the diagram 420 shows the front sight assembly 402 and the rear sight assembly 404 in the first deployed configuration.

Figure 4D:
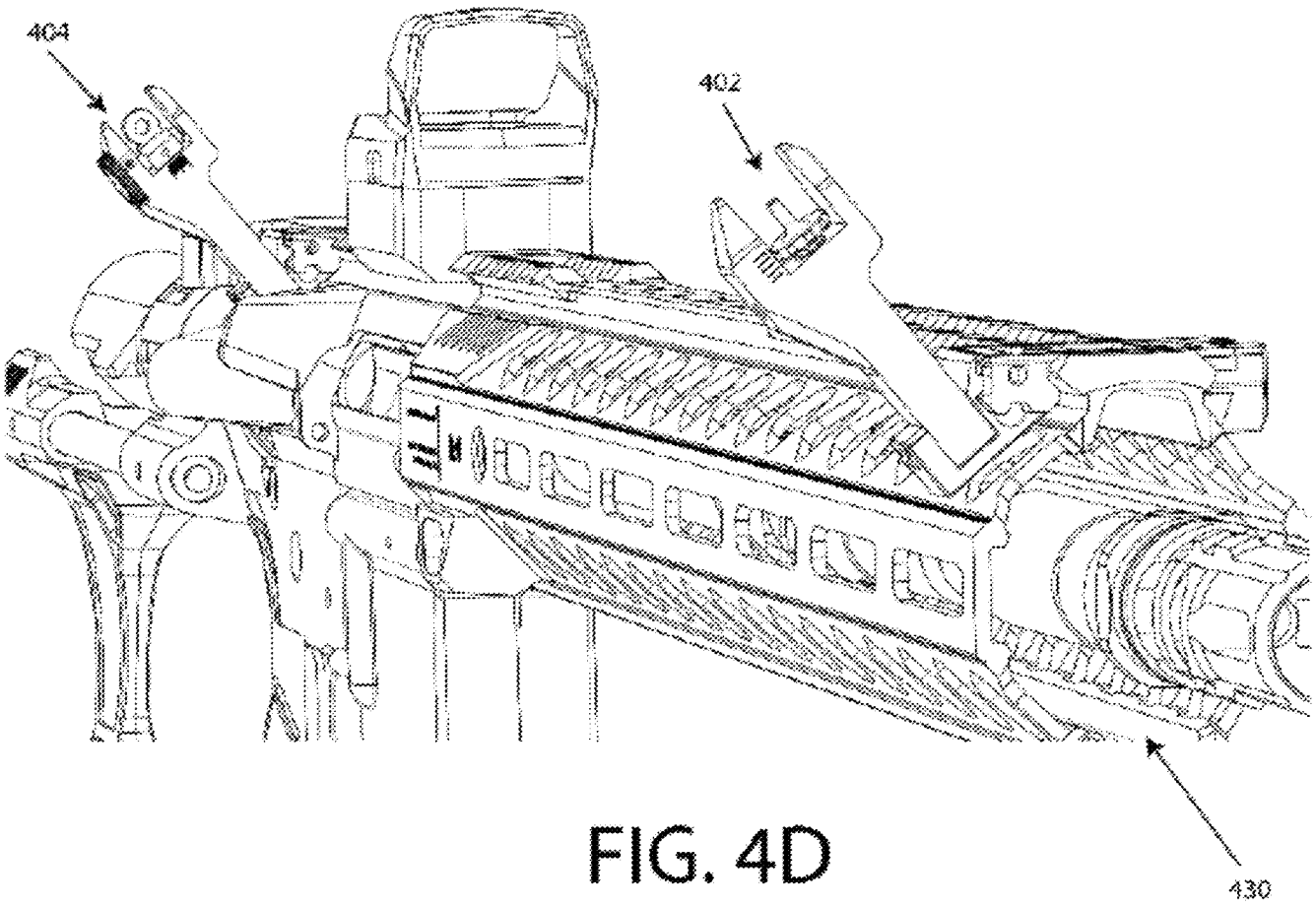
FIGS. 4D-F are diagrams illustrating a flip sight system transitioning from a first deployed configuration to a second deployed configuration in accordance with an embodiment of the invention.
Figure 4E:
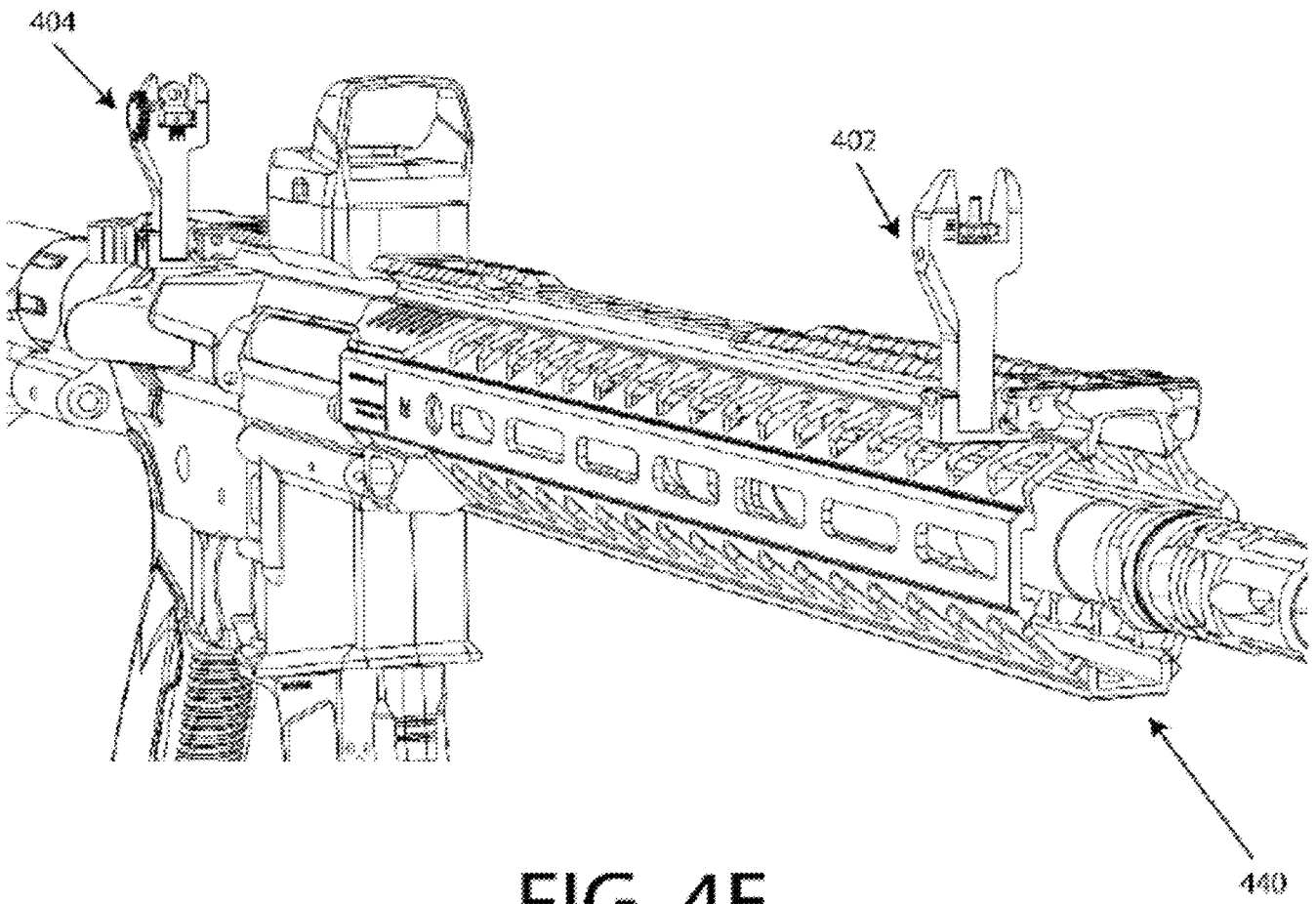
Figure 4F:
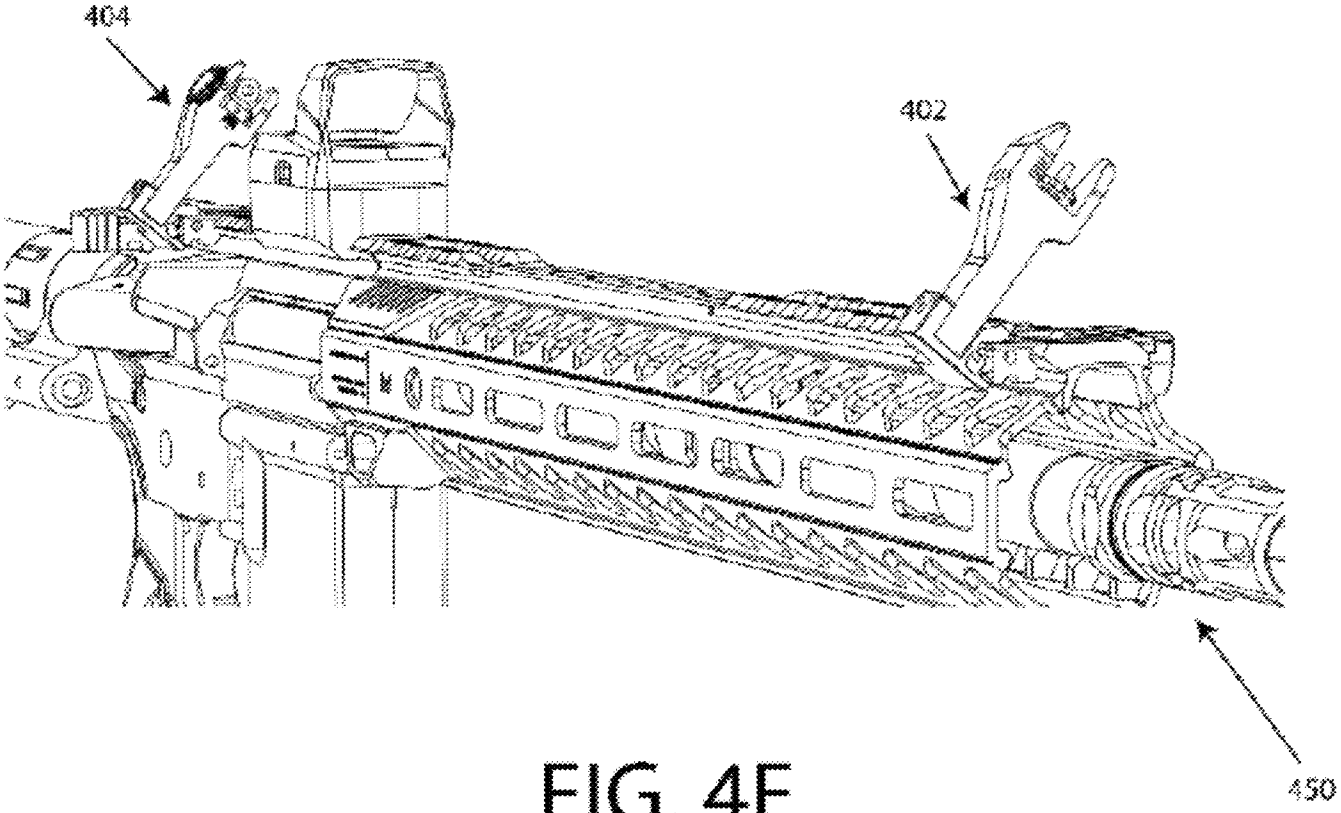

Diagrams illustrating a flip sight system transitioning from a first deployed configuration to a second deployed configuration in accordance with an embodiment of the invention are illustrated in FIGS. 4D-F. In the first time sequence, the diagram 430 shows the front sight assembly 402 and the rear sight assembly 404 in a first deployed configuration as discussed above. In the second time sequence, the diagram 440 shows the front sight assembly 402 and the rear sight assembly 404 in transition from the first deployed configuration to the second deployed configuration. In the third time sequence, the diagram 450 shows the front sight assembly 402 and the rear sight assembly 404 in the second deployed configuration. Although specific configurations and transitions between configurations for flip sight systems are discussed above with respect to FIGS. 3A-4F, any configurations and transitions between configurations for flip sight systems as appropriate to the requirements of a specific application can be utilized in accordance with embodiments of the invention. Considerations of bore axis in accordance with embodiments of the invention are further described below.

Bore Axis Considerations

It is typically desirable to keep firearm sights as close to the firearm's bore axis as possible. Firearms with a large bore to sight distance may need more sight adjustment when shifting between shooting at different targets. Conversely, a firearm with a short bore to sight distance will need less sight adjustment when changing between targets.

Figure 5A:
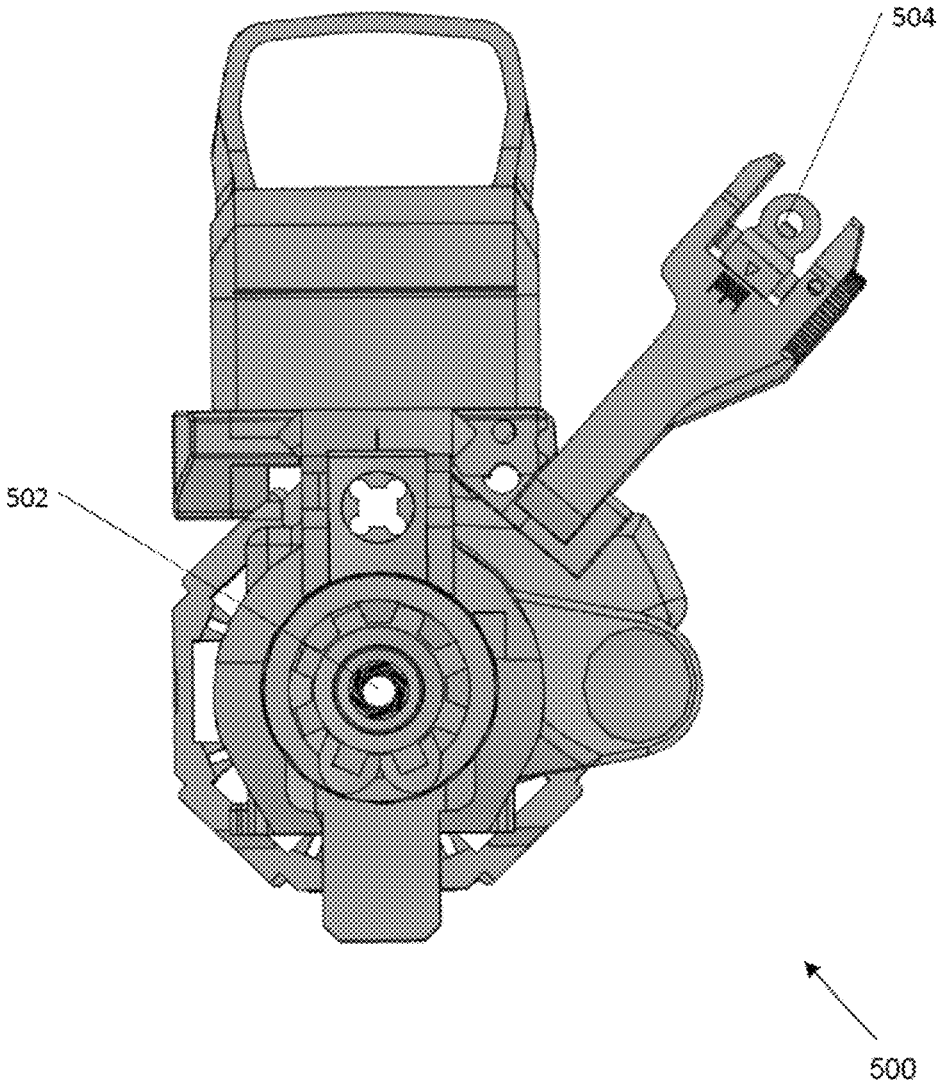
FIGS. 5A-B is a rear side view of schematic diagrams illustrating a flip sight system in a first deployed configuration and a second deployed configuration, respectively, in accordance with an embodiment of the invention.
Figure 5B:
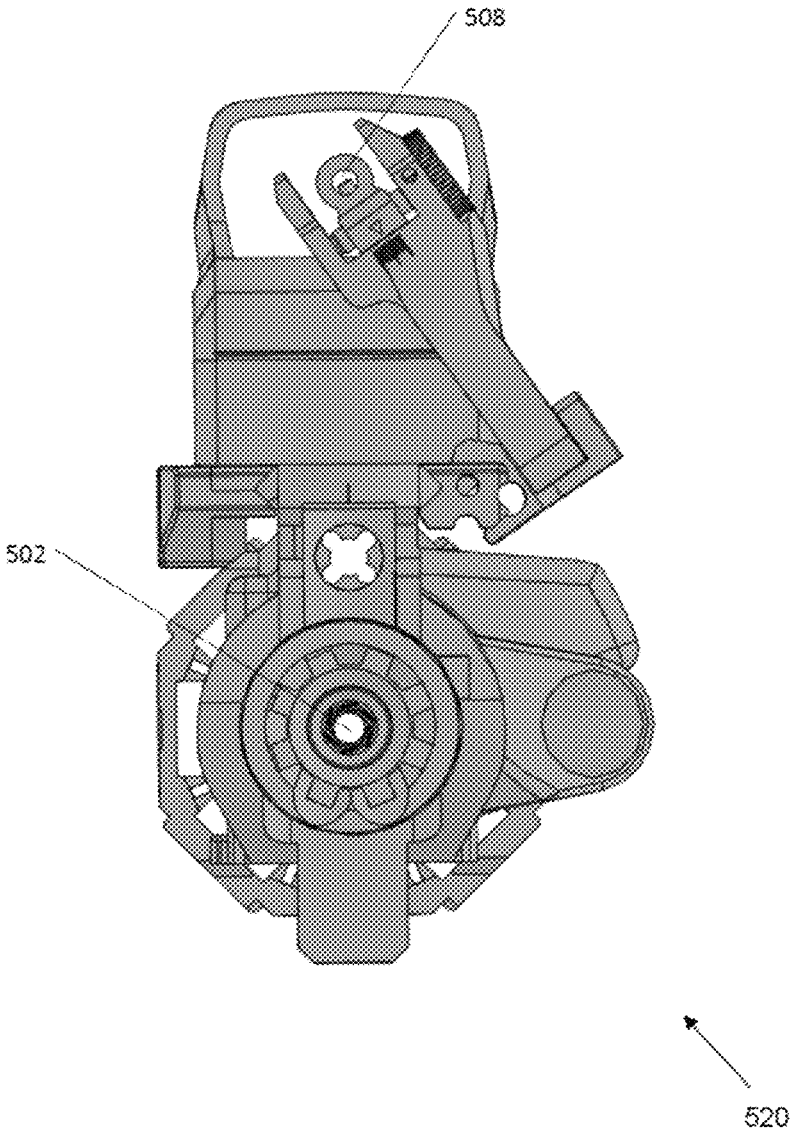

A rear side view of schematic diagrams illustrating a flip sight system in a first deployed configuration and a second deployed configuration are illustrated in FIGS. 5A-B, respectively, in accordance with an embodiment of the invention. In reference to FIG. 5A, the diagram 500 shows a flip sight system in a first deployed configuration as described above. The diagram 500 also shows a center of the firearm's bore axis 502 and a point of alignment 504 of the front and rear sight assemblies. In reference to FIG. 5B, the diagram 520 shows a flip sight system in a second deployed configuration as described above. The diagram 520 also shows the center of the firearm's bore axis 502 and a point of alignment 508 of the front and rear sight assemblies.

In many embodiments, the distance between the center of the bore axis 502 and the point of alignment 504 (may also be referred to as "bore to sight distance") may be configured as appropriate to the requirements of a specific application. For example, the bore to sight distance in the first deployed configuration may be larger than the bore to sight distance in the second deployed configuration. In further embodiments, the bore to sight distance in the first deployed configuration may be smaller than the bore to sight distance in the second deployed configuration. In additional embodiments, the bore to sight distance in the first deployed configuration may be equal to the bore to sight distance in the second deployed configuration. It may be advantageous to keep the change in bore to sight distance in the first and second deployed configurations to a minimum to keep sight adjustment sensitivity similar or relatively unchanged between the first and second deployed configurations.

Although specific bore axis considerations for flip sight systems are discussed above with respect to FIGS. 5A-B, any of a variety of bore axis considerations for flip sight systems as appropriate to the requirements of a specific application can be utilized in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A flip sight system having a plurality of configurations and implementable on a firearm, comprising:

a front sight assembly configured to attach to a rail which is on a top side of the firearm, comprising:

a front base configured to attach the front sight assembly to the firearm;

a front pivot joint; and a front sight attached to the front base via the front pivot joint;

a rear sight assembly configured to attach to the rail which is on the top side of the firearm, comprising:

a rear base configured to attach the rear sight assembly to the firearm;

a rear pivot joint; and a rear sight attached to the rear base via the rear pivot joint;

wherein, when the flip sight system is in a first deployed configuration of the plurality of configurations, the front sight and the rear sight protrude from the firearm and are offset from the top side of the firearm such that no portion of the front sight and the rear sight is directly above the rail or the top side of the firearm;

wherein, when the flip sight system is in a second deployed configuration of the plurality of configurations when an attached optics is mounted on the rail, the front sight and the rear sight are in-line with the attached optics such that the flip sight system operates as co-witness and backup sights to the attached optics;

wherein, when the flip sight system is in a first collapsed configuration of the plurality of configurations, the front sight and the rear sight are folded down toward the firearm and are offset from the top side of the firearm such that no portion of the front sight and the rear sight is directly above the rail or the top side of the firearm;

wherein, when the flip sight system is in a second collapsed configuration of the plurality of configurations, the front sight and the rear sight are folded down toward the firearm and are offset from the top side of the firearm such that no portion of the front sight and the rear sight is directly above the rail or the top side of the firearm.

2. The flip sight system of claim 1, wherein:

the front base includes a first detent stop and a second detent stop;

the front pivot joint includes a spring detent for engaging with the first detent stop or the second detent stop of the front base, a deployed detent stop, and a collapsed detent stop; and the front sight includes a front alignment marker and an internal spring detent for engaging with the deployed dent stop or the collapsed dent stop of the front pivot joint.

3. The flip sight system of claim 2, wherein the rear base includes a first detent stop and a second detent stop;

the rear pivot joint includes a spring detent for engaging with the first detent stop or the second detent stop of the base, a deployed detent stop, and a collapsed detent stop; and the rear sight includes a rear alignment marker and an internal spring detent for engaging with the deployed dent stop or the collapsed dent stop of the rear pivot joint.

4. The flip sight system of claim 3, wherein the flip sight system is in the first deployed configuration when:

the front sight assembly is configured such that:

the spring detent of the front pivot joint is engaged with the first detent stop of the front base; and the internal spring detent of the front sight is engaged with the deployed detent stop of the front base; and the rear sight assembly is configured such that:

the spring detent of the rear pivot joint is engaged with the first detent stop of the rear base; and the internal spring detent of the rear sight is engaged with the deployed detent stop of the rear base.

5. The flip sight system of claim 4, wherein the flip sight system is in the second deployed configuration when:

the front sight assembly is configured such that:

the spring detent of the front pivot joint is engaged with the second detent stop of the front base; and the internal spring detent of the front sight is engaged with the deployed detent stop of the front base; and the rear sight assembly is configured such that:

the spring detent of the rear pivot joint is engaged with the second detent stop of the rear base; and the internal spring detent of the rear sight is engaged with the deployed detent stop of the rear base.

6. The flip sight system of claim 5, wherein the flip sight system is in the first collapsed configuration when:

the front sight assembly is configured such that:

the spring detent of the front pivot joint is engaged with the first detent stop of the front base; and the internal spring detent of the front sight is engaged with the collapsed detent stop of the front base; and the rear sight assembly is configured such that:

the spring detent of the rear pivot joint is engaged with the first detent stop of the rear base; and the internal spring detent of the rear sight is engaged with the collapsed detent stop of the rear base.

7. The flip sight system of claim 6, wherein the flip sight system is in the second collapsed configuration when:

the front sight assembly is configured such that:

the spring detent of the front pivot joint is engaged with the second detent stop of the front base; and the internal spring detent of the front sight is engaged with the collapsed detent stop of the front base; and the rear sight assembly is configured such that:

the spring detent of the rear pivot joint is engaged with the second detent stop of the rear base; and the internal spring detent of the rear sight is engaged with the collapsed detent stop of the rear base.

8. The flip sight system of claim 1, wherein, when the attached optics is mounted on the rail, the attached optics is positioned between the front sight assembly and the rear sight assembly.

9. The flip sight system of claim 1, wherein, when the attached optics is mounted on the rail, the attached optics is one of a telescopic sight, electronic red dot sight, holographic sight, and open sight.

10. The flip sight system of claim 1, wherein, when in the first deployed configuration and when the attached optics is mounted on the rail, the front sight and the rear sight are offset to the attached optics by 45 degrees from a center line of the firearm.

11. The flip sight system of claim 1, wherein the flip sight system is attached to the rail using one of a clamp and a quick detachment mount.

12. The flip sight system of claim 2, wherein the front alignment marker is a post that is click adjustable for elevation using a knob.

13. The flip sight system of claim 3, wherein the rear alignment marker is an aperture that is click adjustable for windage using a knob.

14. The flip sight system of claim 1, wherein the front sight assembly and the rear sight assembly operate independently of each other.

15. The flip sight system of claim 3, wherein the rear alignment mark of the rear sight assembly matches up with the front alignment mark of the front sight assembly at a point of alignment.

16. The flip sight system of claim 15, wherein a bore to sight distance is measured as the distance between the point of alignment and a center of a bore axis of a firearm.

17. The flip sight system of claim 16, wherein the bore to sight distance is larger in the first deployed configuration than in the second deployed configuration.

18. The flip sight system of claim 16, wherein the bore to sight distance is smaller in the first deployed configuration than in the second deployed configuration.

19. The flip sight system of claim 16, wherein the flip sight system transitions from the first deployed configuration to the second deployed configuration by rotating of the front and rear sights about a longitudinal axis to the bore axis.

20. The flip sight system of claim 1, wherein, when the flip sight system is in the first collapsed configuration, the front sight and the rear sight are folded down toward the firearm in a first orientation, and wherein, when the flip sight system is in the second collapsed configuration, the front sight and the rear sight are folded down toward the firearm in a second orientation different from the first orientation.

* * * * *